United States Patent [19]

Hansen

[11] 4,417,626

[45] Nov. 29, 1983

[54] ADJUSTABLE PENDENT SPRINKLER ASSEMBLY

[75] Inventor: Arne Hansen, Doylestown, Pa.

[73] Assignee: Interfit, Inc., Wayne, Pa.

[21] Appl. No.: 397,223

[22] Filed: Jul. 12, 1982

[51] Int. Cl.[3] ..... A62C 37/08

[52] U.S. Cl. ..... 169/37

[58] Field of Search ..... 169/37, 38, 39, 40, 169/41, 51, 52; 239/600; 285/302, 331

[56] References Cited

U.S. PATENT DOCUMENTS

| | | | |
|---|---|---|---|
| 2,180,258 | 11/1939 | Rowley | 169/41 |
| 2,850,264 | 9/1958 | Grable | 285/302 |
| 3,529,671 | 9/1970 | Adams, Jr. | 285/302 |
| 3,584,689 | 6/1971 | Willms | 169/38 |
| 3,675,952 | 7/1972 | Mears | 285/302 |
| 3,807,503 | 4/1974 | Iasillo, Sr. | 285/302 |
| 4,007,878 | 2/1977 | Anderson | 169/37 |
| 4,091,872 | 5/1978 | Mountford | 169/37 |
| 4,228,858 | 10/1980 | Sclafani | 169/41 |

*Primary Examiner*—John J. Love
*Assistant Examiner*—Jon M. Rastello
*Attorney, Agent, or Firm*—Harding, Earley, Follmer & Frailey

[57] ABSTRACT

An adjustable pendent sprinkler assembly has a thermally activated sprinkler head with a releasable cap and a tube spaced above the sprinkler head for securing the assembly to a sprinkler system tee. A plug is slidably mounted in the upper end of the tube where it is retained against downward movement by a release mechanism. An outer sleeve is threaded to the tube and fixedly secured to the sprinkler head for raising and lowering the sprinkler head. An inner sleeve is mounted in the tube for axial movement only and is spaced above the sprinkler head with its upper end holding the release mechanism against release. An intermediate sleeve is threaded to the inner sleeve and has its lower end supported end by the releasable cap of the sprinkler head to releasably support the assembled inner and intermediate sleeves which have inner diameters greater than the outer diameter of the plug to provide for passage of the plug therethrough on its release. The intermediate sleeve is connected to the sprinkler head and tube assembly for rotation therewith and relative axial movement with respect thereto. The threaded connections are such that for a given amount of rotation, the intermediate sleeve and the outer sleeve will move the same axial distance.

9 Claims, 1 Drawing Figure

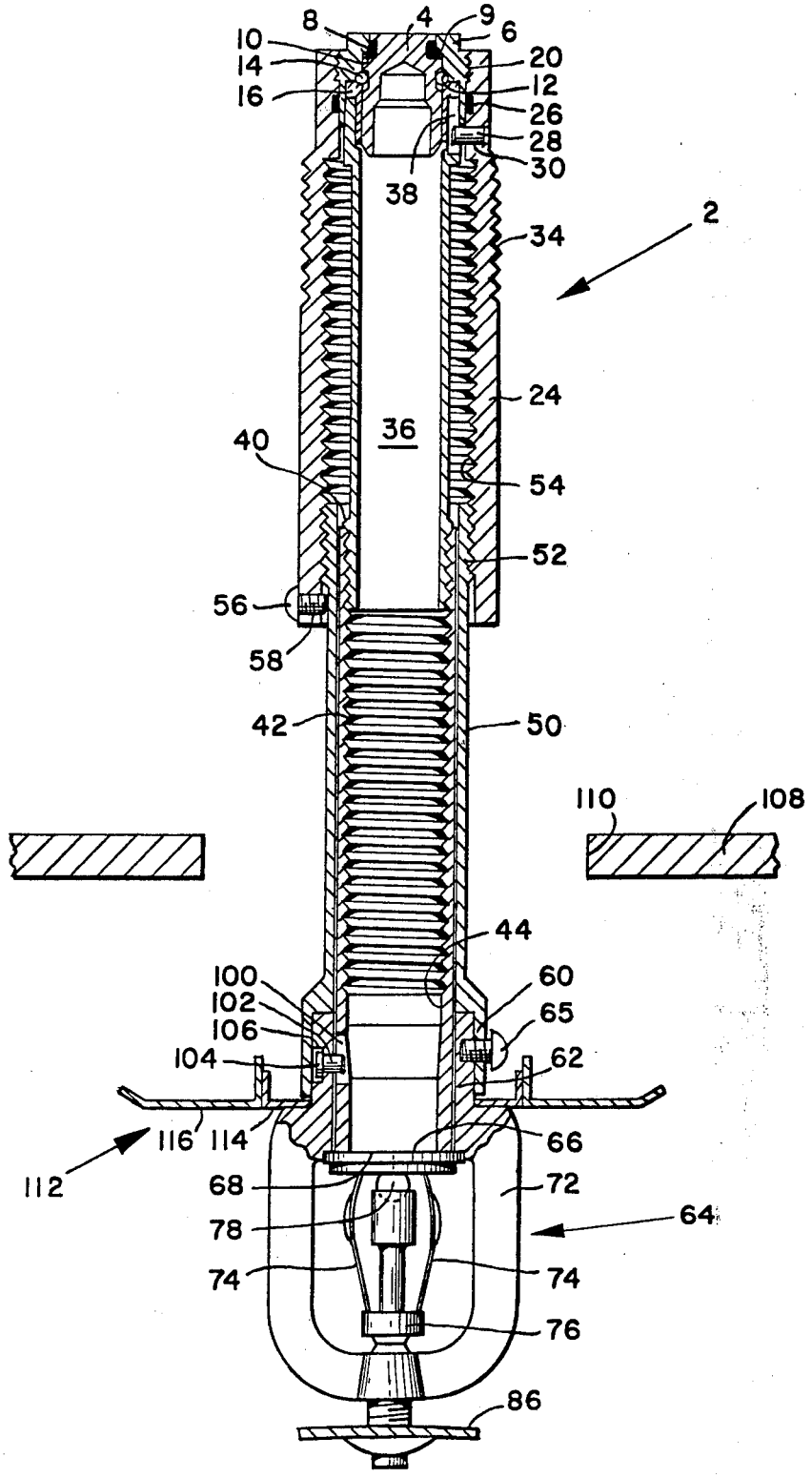
8
4
9
6
10
14
16
20
12
26
28
30
38
2
34
24
36
40
54
52
56
58
42
50
110
108
44
100
102
106
104
60
65
62
116
114
66
112
68
72
78
64
74
74
76
86

ADJUSTABLE PENDENT SPRINKLER ASSEMBLY

TECHNICAL FIELD

This invention is in the field of fire fighting equipment.

BACKGROUND OF THE PRIOR ACT

It is well known in the prior art to employ dry pipe automatic sprinkler systems for control of fires. Such systems have air under pressure in the distribution pipes. A drop of pressure triggers the opening of a valve permitting the entry of water to the system. Since there is a possibility of leakage of air out of the system when no fire exists, it is known to employ a valve mechanism associated with each sprinkler head to prevent the discharge of water until such time as heat activates the sprinkler head. Such valves are also employed in pipes connecting sprinkler heads to distribution pipes filled with water where the distribution pipes are in a heated area and the sprinkler heads are located in an unheated area where freezing is possible. Such pendent pipes and sprinkler heads are conventionally referred to as pendent sprinkler assemblies.

The distribution pipes for sprinkler systems are generally installed a considerable period of time before the installation of the ceiling which is installed below such pipes. The general practice has been to install the pendent sprinkler assembly after the installation of the ceiling thus denying the structure the protection of the sprinkler system until the ceiling has been installed. To overcome this deficiency, vertically adjustable wet pipe pendent sprinkler assemblies have been developed as seen for example in U.S. Pat. Nos. 3,529,671, 3,675,952 and 3,807,503. Such an assembly can be installed at the same time that the distribution pipes are being installed and thus give the structure involved the protection of the sprinkler system well prior to the installation of the ceiling. Once the ceiling is installed, the assembly is vertically adjusted to position an escutcheon against the ceiling.

Dry pipe devices such as that disclosed in U.S. Pat. No. 4,007,878 and similar devices wherein threaded connections are employed for vertical adjustment in lieu of a collet are expensive since they require a special fitting to accommodate the upward and downward movement of the pendent tube and slidable plug assembly rather than having the latter assembly connect directly into a tee of the distribution system. They also require that the assembly be vertically offset from the distribution pipe as distinguished from the conventional assembly which lies in the same vertical plane as the distribution pipe.

The adjustable pendent sprinkler assembly of the invention eliminates the above discussed disadvantages of the prior art adjustable dry pipe pendent sprinkler assemblies.

BRIEF SUMMARY OF THE INVENTION

An adjustable pendent sprinkler assembly has a thermally activated sprinkler head with a releaseable cap and a tube spaced above the sprinkler head for securing the assembly to a sprinkler system tee. A plug is mounted in the upper end of the tube where it is retained against downward movement by a release mechanism. An outer sleeve is threaded to the tube and fixedly secured to the sprinkler head for raising and lowering the sprinkler head. An inner sleeve is mounted in the tube for axial movement only and is spaced above the sprinkler head with its upper end holding the release mechanism against the release. An intermediate sleeve is threaded to the inner sleeve and has its lower end supported by the releasable cap of the sprinkler head to releasably support the assembled inner and intermediate sleeves which have inner diameters greater than the outer diameter of the plug to provide for passage of the plug therethrough on its release. The intermediate sleeve is connected to the sprinkler head and tube assembly for rotation therewith and relative axial movement with respect thereto. The threaded connections are such that for a given amount of rotation, the intermediate sleeve and the outer sleeve will move the same axial distance.

Advantageously, the tube has a pin in engagement with a slot in the inner sleeve to prevent the rotation of the inner sleeve while permitting limited axial movement of the inner sleeve and the sprinkler head has a pin in engagement with a slot in the intermediate sleeve to cause the intermediate sleeve to rotate with the sprinkler head and outer sleeve assembly while permitting limited axial movement of the intermediate sleeve.

BRIEF DESCRIPTION OF THE DRAWINGS

The FIGURE is a vertical section through a pendent sprinkler assembly in accordance with the invention.

DETAILED DESCRIPTION

A pendent sprinkler assembly 2 in accordance with the invention has a hollow plug 4 mounted in a collar 6 with a seal formed therebetween by an O-ring 8. Collar 6 has a shoulder 9 adapted to be engaged by a shoulder 10 on the plug 4 to limit the upward movement of plug 4 with respect to the collar. Plug 4 and collar 6 together form a race 12 which is filled with ball bearings 14. In turn, ball bearings 14 are held against plug 4 and collar 6 to prevent the downward movement of plug 4 by a thrust collar 16. Collar 6 is threadably secured as indicated at 20 to a tube 24 with an O-ring 26 therebetween to provide a seal. A pin 28 is secured by a pressed fit in an opening 30 in tube 24 and projects into the interior of tube 24. Tube 24 is threaded as indicated at 34 for the securing of tube 24 to a tee of a sprinkler system (not shown).

An inner sleeve 36 is mounted in tube 24 and has a vertically elongated slot 38 of a width to snugly receive pin 28 to prevent the rotation of inner sleeve 36 while permitting it to move vertically. Sleeve 36 abuts against thrust collar 16 retaining it against ball bearings 14.

The thus far described plug and its holding mechanism are old in the art.

Inner sleeve 36 has an enlarged externally threaded portion 40 which engages the internal threads 42 of an intermediate sleeve 44 mounted within an outer sleeve 50 which has an enlarged externally threaded portion 52 engaging inner threads 54 of tube 24. The threads of the threaded connections between inner sleeve 36 and intermediate sleeve 44 and between outer sleeve 50 and tube 24 are of the same type and have the same pitch (number of threads per inch) to provide for the same amount of axial movement of sleeves 44 and 50 for any given amount of rotation. A screw 56 is threaded in opening 58 and acts as a stop to limit the downward travel of enlarged portion 52 of sleeve 50.

Outer sleeve 50 has an enlarged end 60 which receives the shank 62 of a sprinkler head 64. A screw 65 is threaded to enlarged end 60 and shank 62 to secure outer sleeve 50 and sprinkler head 64 together. Sprinkler head 64 has a cap 66 which abuts against the lower end 68 of intermediate sleeve 44 and against sprinkler head frame 72 to prevent the downward movement of sleeve 44. Ejector leaf springs 74 are interposed between cap 66 and pedestal 76 mounted on frame 72. Also interposed between cap 66 and pedestal 76 is a thermally activated element 78 which will collapse at a predetermined temperature to permit the release of ejector springs 74 and cap 66. Sprinkler head 64 has a splash deflector 86. Sprinkler head 64 is conventional and well known to the art and need not be further detailed. Sprinkler head 64 is merely illustrative, it being obvious that a wide variety of sprinkler heads known to the art can be used with the invention.

Intermediate sleeve 42 has a vertically elongated slot 100 of a width to snugly receive pin 102 which has a head 104 recessed in opening 106 in shank 62. Pin 102 is contained in slot 100 by the enlarged portion 60 of outer sleeve 50. This causes intermediate sleeve 44 to rotate with outer sleeve 50 and limits the downward vertical movement of sleeves 44 and 36 when cap 66 is released.

The pendent sprinkler assembly 2 is shown assembled with a ceiling panel 108 having a receiving opening 110. An escutcheon 112 mounted on sprinkler head 64 has a conventional inner ring 114 and outer ring 116 removably attached to ring 114 by means not shown. Escutcheon 112 is adapted to cover opening 110. Any of the well known types of escutcheons can be used.

On the installation of the pendent sprinkler assembly 2 in a sprinkler system which normally occurs before the ceiling 108 is installed, intermediate sleeve 44 and outer sleeve 50 will be threaded to an intermediate position with respect to inner sleeve 36 and tube 24 respectively. Once the ceiling 108 is installed, sprinkler head 72 will be rotated with a suitable wrench to move intermediate sleeve 44 axially upwardly with respect to inner sleeve 36 and outer sleeve 50 axially upwardly with respect to tube 24 at exactly the same rate by virtue of outer sleeve 50 being fixedly secured by screw 65 to sprinkler head 64 which in turn is connected to intermediate sleeve 44 by slot 100 and pin 102. Rotation is continued until escutcheon 112 contacts ceiling 108.

OPERATION

In operation, when a fire causes sprinkler head 64 to release cap 66, the pressure of the fluid in the sprinkler system moves plug 4, ball bearings 14, thrust collar 16, inner sleeve 36 and intermediate sleeve 44 downwardly. As ball bearings 14 move below collar 6 they are cammed outwardly and hence clear of plug 4. Inner sleeve 36 and intermediate sleeve 44 continue to move downwardly until the top of slot 100 reaches pin 102 stopping further movement. Plug 4 is forced downwardly through inner sleeve 36 and intermediate sleeve 44 and passes out through the lower end of sleeve 44 to permit the free flow of fluid (which may be initially air and then water) from the sprinkler system down through the entire pendent assembly and to the splash deflector 86.

I claim:

1. An adjustable pendent sprinkler assembly comprising:

a thermally activated sprinkler head having a releasable cap, a tube spaced above the sprinkler head for securing the assembly to a sprinkler system tee, a plug mounted in the upper end of the tube, releasable means for releasably holding the plug against downward movement, an outer sleeve threaded to the tube and fixedly secured to the sprinkler head for raising and lowering the sprinkler head, an inner sleeve mounted in the tube for axial movement only and spaced above the sprinkler head with its upper end holding the releasable means against release, an intermediate sleeve threaded to the inner sleeve and having its lower end supported by said releasable cap to releasably support the assembled inner and intermediate sleeves, said inner and intermediate sleeves having inner diameters greater than the outer diameter of the plug to provide for passage of the plug therethrough on its release, and means for connecting the intermediate sleeve to the sprinkler head and tube assembly for rotational movement therewith and relative axial movement with respect thereto, for a given amount of rotation said intermediate sleeve and said outer sleeve moving the same axial distance.

2. The assembly of claim 1 in which the intermediate sleeve is threaded to the exterior of the inner sleeve and the outer sleeve is threaded to the interior of the tube.

3. The assembly of claims 1 or 2 having a stop for limiting the downward threaded travel of the intermediate and outer sleeves.

4. The assembly of claim 1 in which the tube has a pin in engagement with a slot in the inner sleeve to prevent the rotation of the inner sleeve while permitting limited axial movement of the inner sleeve.

5. The assembly of claim 1 having means for limiting the downward axial movement of the inner and intermediate sleeves when the sprinkler cap is released.

6. The assembly of claim 1 in which the tube has a pin in engagement with a slot in the inner sleeve to prevent the rotation of the inner sleeve while permitting limited axial movement of the inner sleeve and the sprinkler head has a pin in engagement with a slot in the intermediate sleeve to cause the intermediate sleeve to rotate with the sprinkler head and outer sleeve assembly while permitting limited axial movement of the intermediate sleeve relative to the outer sleeve.

7. The assembly of claim 6 in which the sprinkler head pin is retained in position by an overlying portion of the intermediate sleeve.

8. A vertically adjustable pendent sprinkler assembly comprising:

a thermally activated sprinkler head having a releasable cap, a tube spaced above the sprinkler head for securing the assembly to a sprinkler system tee, a plug slidably mounted in the upper end of the tube, releasable means for releasably holding the plug against downward movement, an outer sleeve threaded to the tube and fixedly secured to the sprinkler head for raising and lowering the sprinkler head, an inner sleeve spaced above the sprinkler head with its upper end holding the releasable means against release and having an axial slot in its upper end, a pin secured in the tube and engaging the axial slot to prevent the rotation of the inner sleeve while permitting it to move axially, an intermediate sleeve threaded to the inner sleeve and having its lower end supported by said releasable cap to releasably support the assembled inner and intermediate sleeves and having an axial slot adjacent its lower end, a pin mounted in the sprinkler head engaging said slot to cause the intermediate sleeve to rotate with the sprinkler head and outer sleeve assembly while permitting axial movement of the intermediate sleeve relative to the outer sleeve, and said inner and intermediate sleeves having inner diameters greater than the outer diameter of the plug to provide for passage of the plug therethrough on its release.

9. An adjustable pendent sprinkler assembly comprising:

a thermally activated sprinkler head, a tube spaced above the sprinkler head for securing the assembly to a sprinkler system, a closure mounted in the upper end of the tube, an outer sleeve threaded to the tube and fixedly secured to the sprinkler head for raising and lowering the sprinkler head, an axially movable system for opening said closure comprising an inner sleeve mounted in the tube for axial movement only and spaced above the sprinkler head, and an intermediate sleeve threaded to the inner sleeve and having its lower end releasably held by the sprinkler head to releasably hold the assembled inner and intermediate sleeves, and means for connecting the intermediate sleeve to the sprinkler head and outer sleeve assembly for rotational movement therewith and relative axial movement with respect thereto, for a given amount of rotation said intermediate sleeve and said outer sleeve moving the same axial distance.

* * * * *